United States Patent [19]

Aiba

[11] 4,430,049

[45] Feb. 7, 1984

[54] RIPPLE REGULATOR IN A LIQUID SUPPLY SYSTEM

[75] Inventor: Masahiko Aiba, Nara, Japan

[73] Assignee: Sharp Kabushiki Kaisha, Osaka, Japan

[21] Appl. No.: 366,704

[22] Filed: Apr. 8, 1982

[30] Foreign Application Priority Data

Apr. 22, 1981 [JP] Japan ..... 56-61833

[51] Int. Cl.[3] ..... F04B 11/00

[52] U.S. Cl. ..... 417/540; 138/31

[58] Field of Search ..... 417/540, 254, 265, 328; 137/568; 138/26, 30, 31; 417/542, 543

[56] References Cited

U.S. PATENT DOCUMENTS 2,811,931 11/1957 Everett ..... 417/540 X
3,456,673 7/1969 Legrand ..... 138/30 X
3,690,736 9/1972 Smirl et al. ..... 138/31 X
4,248,268 2/1981 Choate ..... 138/31 X

*Primary Examiner*—Carlton R. Croyle
*Assistant Examiner*—Donald E. Stout
*Attorney, Agent, or Firm*—Birch, Stewart, Kolasch & Birch

[57] ABSTRACT

A liquid supply system comprising a plunger pump and a ripple regulating system. The ripple regulating system includes a ripple regulator having a pressure chamber of which one wall is implemented with a bellowphragm for varying the volume of the pressure chamber. A solenoid mechanism is associated with the bellowphragm to shift the bellowphragm. The solenoid mechanism is activated in synchronization with the drive of the plunger pump, thereby minimizing the pressure ripples generated by the plunger pump.

4 Claims, 7 Drawing Figures

RIPPLE REGULATOR IN A LIQUID SUPPLY SYSTEM

BACKGROUND AND SUMMARY OF THE INVENTION

The present invention relates to a liquid supply system and, more particularly, to a ripple regulator for removing ripples generated by a pump included in the liquid supply system.

The present invention is to provide an ink liquid supply system in an ink jet system printer for ensuring a constant flow rate of the ink liquid to be supplied to a nozzle.

Generally, when a piston activated pump is employed in a liquid supply system, ripples are generated in the liquid. The thus generated ripples influence on the constant flow rate supply. Especially in an ink jet system printer of the charge amplitude controlling type, the constant flow rate supply is very important to achieve a correct and clean printing.

Therefore, a ripple regulator is usually disposed in the liquid supply system. However, the conventional ripple regulator is not suited for both minimizing the ripple pressure and shortening the response time.

Accordingly, an object of the present invention is to provide a novel ripple regulator for use in a liquid supply system.

Another object of the present invention is to minimize the ripple pressure and to shorten the response time of a ripple regulator in a liquid supply system employing a piston activated pump.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a solenoid mechanism is connected to a bellowphragm of a ripple regulator. The solenoid mechanism is driven in synchronization with the activation of a liquid supply pump so that the ripples generated by the liquid supply pump are absorbed by the volume variation of a pressure chamber included in the ripple regulator.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

In a liquid supply system including a piston activated pump system, pressure ripples are inevitably generated due to the piston movement. The pressure ripples must be minimized when the liquid supply system is designed to operate as a constant flow rate liquid supply system. The constant flow rate supply is highly required in, for example, an ink jet system printer of the charge amplitude controlling type.

Figure 7:
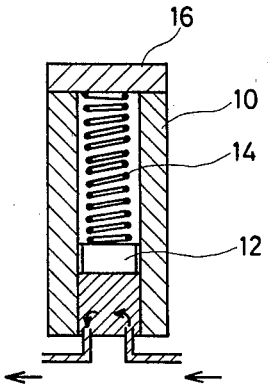
FIG.7 PRIOR ART
FIG. 7 is a sectional view of a ripple regulator of prior art.

To minimize the pressure ripples, a ripple regulator is generally provided in the liquid supply system. FIG. 7 shows a typical construction of the conventional ripple regulator employed in the liquid supply system for the ink jet system printer of the charge amplitude controlling type. The conventional ripple regulator of FIG. 7 includes a cylinder 10, and a piston 12 slidably disposed in the cylinder 10. A spring 14 is disposed between the piston 12 and a cylinder head 16 to absorb the pressure ripples.

The ripple pressure $P_{RP}$ in the ripple regulator can be expressed as follows:

$$P_{RP} = K_1 \cdot \frac{k}{S^2}$$

where:

k is the spring constant of the spring 14;

S is the size of the piston 12; and $K_1$ is a constant.

Further, the pressure response time T of the ripple regulator can be expressed as follows:

$$T = K_2 \cdot \frac{S^2}{k}$$

where: $K_2$ is a constant.

It will be clear that the ripple pressure $P_{RP}$ is reduced as the spring constant k is small and the piston size S is large.

On the other hand, the pressure response time T should be short in order to ensure the constant flow rate supply even when the ambient condition varies. When, for example, the ambient temperature varies, the liquid viscosity varies. Thus, the balance pressure in the liquid supply system varies depending on the ambient temperature. Therefore, the ripple regulator must rapidly respond to the variation of the balance pressure. The pressure response time T represents a response time at which the size of the pressure chamber of the ripple regulator is varied in response to the variation of the mean pressure of the liquid introduced into the ripple regulator. The pressure response time T is lengthened as the spring constant k is small and the piston size S is large.

Accordingly, in the conventional ripple regulator, it is impossible to reduce the ripple pressure $P_{RP}$ without lengthening the pressure response time T.

In accordance with the present invention, the spring constant k is selected large to shorten the response time T. Furthermore, a novel system is provided to minimize the ripple pressure $P_{RP}$.

Figure 1:
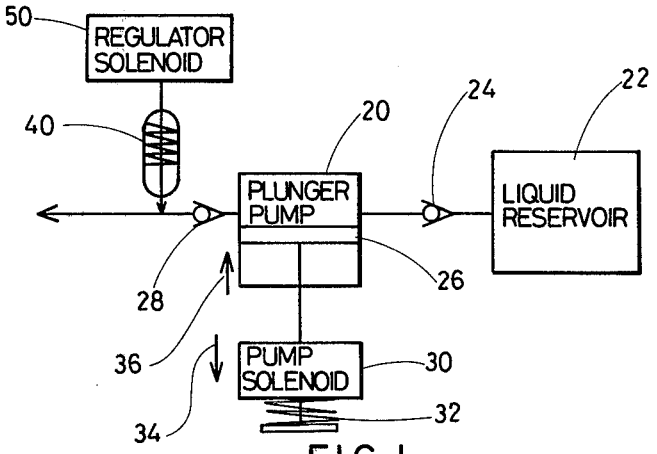
FIG. 1 is a schematic block diagram of a liquid supply system including a ripple regulating system of the present invention.

FIG. 1 shows a liquid supply system employing an embodiment of a ripple regulating system of the present invention. A plunger pump 20 is connected to a liquid reservoir 22 via an inlet valve 24. THe liquid contained in the liquid reservoir 22 is introduced into the plunger pump 20 through the inlet valve 24 in response to the movement of a piston 26, and developed through an outlet valve 28. The piston 26 is secured to a plunger of a pump solenoid 30. The plunger of the pump solenoid 30 is pulled by a spring 32 in a direction shown by an arrow 34.

Accordingly, when the pump solenoid 30 is activated, the piston 26 is driven to shift in a direction shown by an arrow 36, thereby developing the liquid via the outlet valve 28. The thus developed liquid includes ripples due to the movement of the piston 26. A ripple regulating system of the present invention is disposed at the downstream of the outlet valve 28 in order to minimize the ripples created by the movement of the piston 26. The ripple regulating system includes a ripple regulator 40 and a regulator solenoid 50 associated with the ripple regulator 40.

Figure 2:
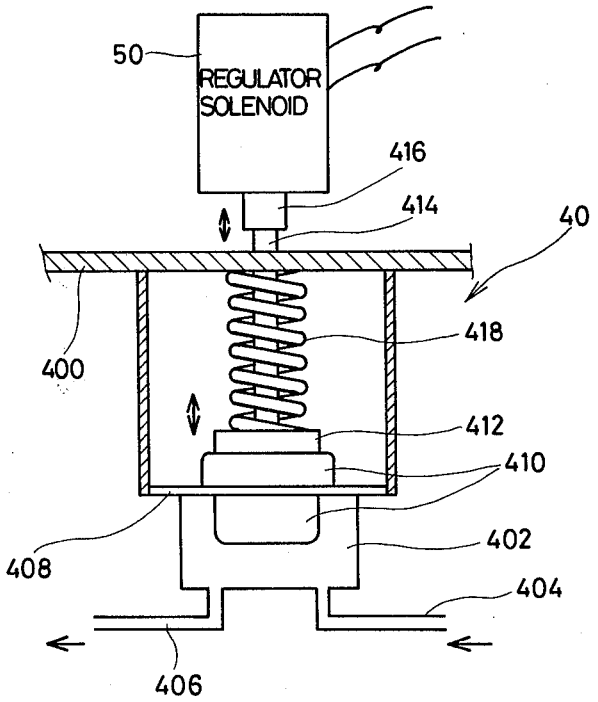
FIG. 2 is a sectional view of an embodiment of a ripple regulator of the present invention.

FIG. 2 shows a construction of the ripple regulator 40 and the regulator solenoid 50. The ripple regulator 40 is secured to a housing 400 of the liquid supply system. The ripple regulator 40 includes a pressure chamber 402 which is communicated with the above-mentioned outlet valve 28 of the plunger pump 20 through a conduit 404. The liquid retained in the pressure chamber 402 is supplied to a desired unit such as an ink droplet issuance unit through a conduit 406. The pressure chamber 402 has an open free end at the upper section thereof. The open free end is covered by a flange 408 of a bellowphragm 410 in order to seal the pressure chamber 402. A cap 412 is secured to the bellowphragm 410. A drive shaft 414 is disposed between the cap 412 and a plunger 416 of the regulator solenoid 50. A spring 418 is disposed between the cap 412 and the housing 400 to depress the bellowphragm 410 downward.

When the regulator solenoid 50 is energized, the plunger 416 is pulled upward to pull the bellowphragm 410 upward via the drive shaft 414 and the cap 412. The volume of the pressure chamber 402 is increased, whereby the liquid pressure in the pressure chamber 402 is reduced. It will be apparent that the pressure ripples can be minimized if the pressure reduction caused by the activation of the regulator solenoid 50 is selected so as to cancel the pressure increase caused by the activation of the pump solenoid 30 associated with the plunger pump 20.

Figure 3:
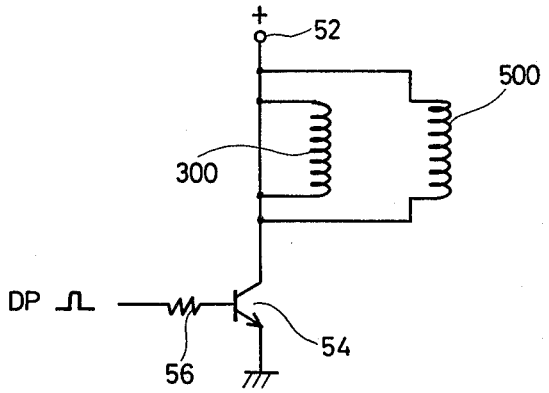
FIG. 3 is a schematic circuit diagram of a solenoid drive system for activating solenoids included in the liquid supply system of FIG. 1.

FIG. 3 shows a drive circuit for the pump solenoid 30 and the regulator solenoid 50. The pump solenoid 30 includes a winding 300, and the regulator solenoid 50 includes a winding 500. The windings 300 and 500 are connected with each other in a parallel fashion. One end of the parallel circuit of the windings 300 and 500 is connected to a power supply terminal 52 which is connected to a D.C. voltage source. The other end of the parallel circuit of the windings 300 and 500 is connected to the collector electrode of a transistor 54. The base electrode of the transistor 54 is connected to receive a drive pulse DP via a resistor 56.

When the drive pulse DP bears the high level, the transistor 54 is turned on to create the electric current through the windings 300 and 500. Accordingly, pump solenoid 30 and the regulator solenoid 50 are activated in synchronization with the drive pulse DP.

Figure 4:
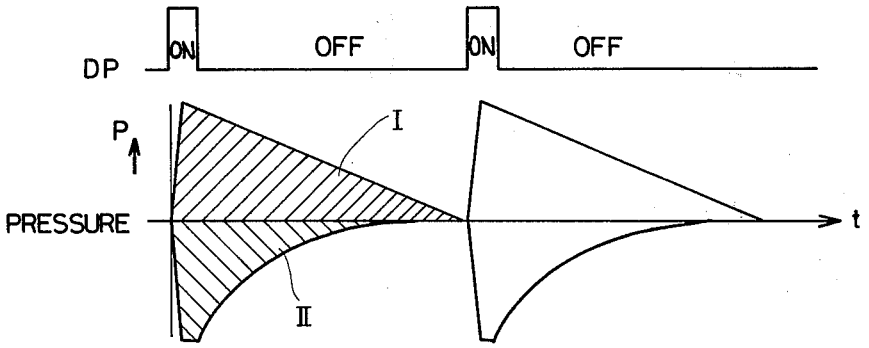
FIG. 4 is a time chart for explaining an operational mode of the ripple regulating system of FIG. 1.

Therefore, when the transistor 54 is turned on, the piston 26 is driven to develop the liquid through the outlet valve 28. The liquid pressure is increased as shown by a curve I in FIG. 4 in response to the activation of the pump solenoid 30. This pressure variation causes the pressure ripples. However, the regulator solenoid 50 is activated in synchronization with the energization of the pump solenoid 30. The volume of the pressure chamber 402 is increased to reduce the liquid pressure as shown by a curve II in FIG. 4.

Figure 5:
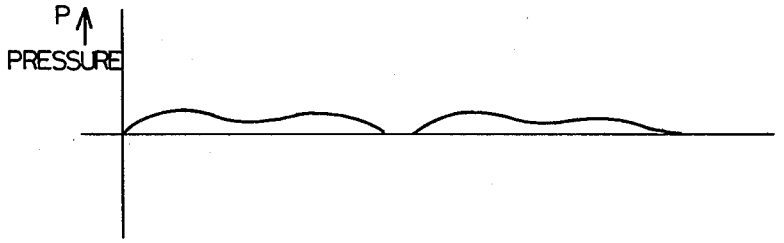
FIG. 5 is a graph for explaining a pressure variation in the liquid supply system of FIG. 1.

The above-mentioned two pressure variations are mixed with each other in the pressure chamber 402. Accordingly, the liquid pressure in the pressure chamber 402 is held substantially constant as shown in FIG. 5.

Figure 6:
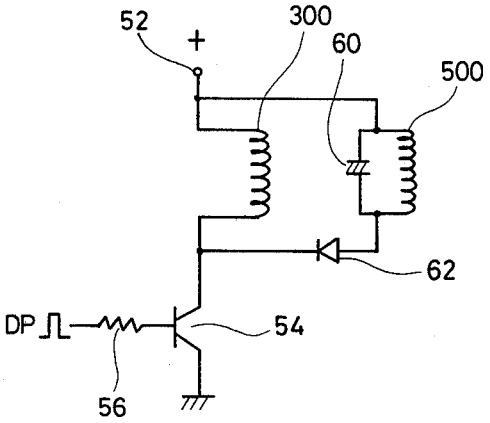
FIG. 6 is a schematic circuit diagram of another embodiment of the solenoid drive system for activating solenoids included in the liquid supply system of FIG. 1.

FIG. 6 shows another embodiment of a driver circuit for the pump solenoid 30 and the regulator solenoid 50. A capacitor 60 is connected to the winding 500 of the regulator solenoid 50 in a parallel fashion. A diode 62 is disposed between the collector electrode of the transistor 54 and the parallel circuit comprising the winding 500 and the capacitor 60. When the transistor 54 is turned on, the electric current flows through the windings 300 and 500, and the capacitor 60 is charged to a preselected level. When the transistor 54 is turned off, the electric current flows through the winding 500 of the regulator solenoid 50 due to the charges charged on the capacitor 60. By properly selecting the capacitance of the capacitor 60, the pressure variation (corresponding to the curve II in FIG. 4) generated by the ripple regulator 40 is controllable.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a liquid supply system including a pump system for developing the liquid by means of a movement of a piston included therein, and a ripple regulating system for minimizing pressure ripples created by said pump system, said ripple regulating system comprising:
   - a ripple regulator including:
     - a pressure chamber;
     - inlet means for introducing the liquid developed from said pump system into said pressure chamber;
     - outlet means for developing the liquid from said pressure chamber; and
     - a resilient member secured to said pressure chamber so as to vary the volume of said pressure chamber;
   - a solenoid mechanism connected to said resilient member for varying said volume of said pressure chamber; and
   - drive control means for activating said solenoid mechanism in synchronization with the movement of said piston included in said pump system.

2. The ripple regulating system in a liquid supply system of claim 1, wherein said resilient member comprises a bellowphragm.

3. The ripple regulating system in a liquid supply system of claim 1 or 2, said ripple regulator further comprising a spring disposed on said resilient member so as to depress said resilient member toward said pressure chamber.

4. The ripple regulating system in a liquid supply system of claim 3, wherein said pump system is a plunger activated pump, and wherein said solenoid mechanism is activated in synchronization with the attracting operation conducted to the plunger included in said plunger activated pump.

* * * * *